United States Patent [19]

Rice

[11] 4,319,234

[45] Mar. 9, 1982

[54] SMOKE DETECTOR WITH DUAL SENSORS

[76] Inventor: Royal K. Rice, 2434 Sleepy Hollow, Glendale, Calif. 91206

[21] Appl. No.: 173,665

[22] Filed: Jul. 29, 1980

[51] Int. Cl.[3] ..... G08B 17/10

[52] U.S. Cl. ..... 340/628; 340/693; 340/629

[58] Field of Search ..... 340/628, 629, 630, 693, 340/545, 546, 321

[56] References Cited

U.S. PATENT DOCUMENTS

| | | | |
|---|---|---|---|
| 2,350,413 | 6/1944 | Ordman | 340/321 |
| 3,261,010 | 7/1966 | Kardel | 340/546 |
| 3,878,539 | 4/1975 | Gouding | 340/546 |
| 3,905,063 | 9/1975 | Coulter et al. | 340/630 |
| 3,968,483 | 7/1976 | Jolley | 340/628 |
| 3,982,237 | 9/1976 | Conville et al. | 340/630 |
| 4,223,203 | 9/1980 | Albinger et al. | 340/628 |

*Primary Examiner*—Gerald L. Brigance
*Attorney, Agent, or Firm*—Erik M. Arnhem

[57] ABSTRACT

Smoke detector, comprising a housing the length side of which is several times greater than the width side thereof, incorporating a sensor and a power source; a U-shaped bracket having a base mounted turnable on the top of the housing, and downwardly directed arms, one of which carries a second sensor interconnected with the first sensor and the power source, which is rotatable from a position adjacent the width sides of the housing into a position of parallel spaced relationship to the length side thereof, for accommodation of an upper door edge between the space within the sensor carrying arm and the length side of the housing.

7 Claims, 4 Drawing Figures

FIG.1
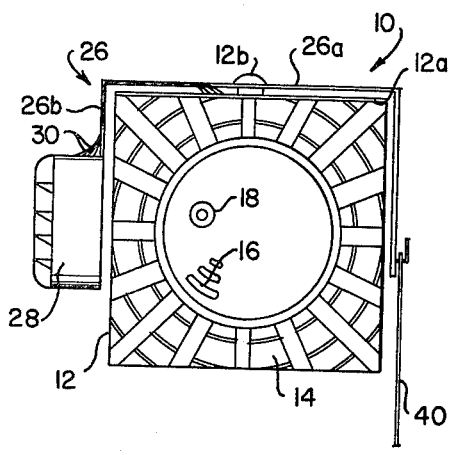
FIG.3
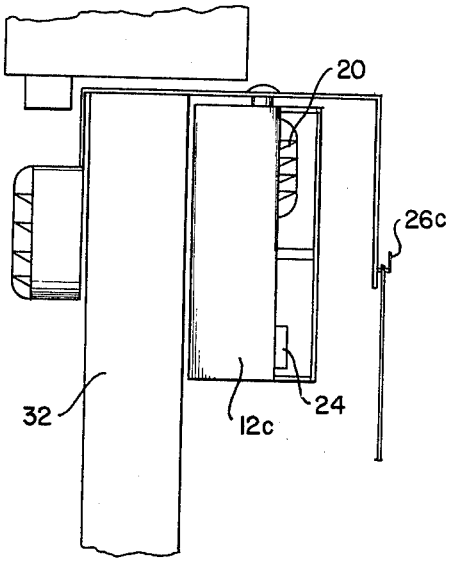
FIG.2
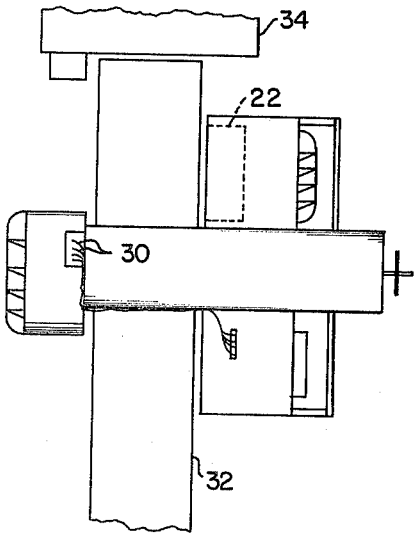
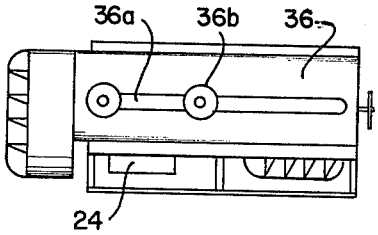
FIG.4

SMOKE DETECTOR WITH DUAL SENSORS

FIELD OF THE INVENTION

Background of the Invention

The invention is primarily concerned with portable smoke and fire detectors, provided with dual interconnected sensor elements, e.g., ionization chambers, adapted to straddle the upper edge of a door, which, e.g., separates a room from a hallway.

Smoke and fire detectors are available in a great variety of types and models, the most popular ones are equipped with an ionization chamber or photocell, operable by means of battery or conventional power.

In order to obtain maximal or near maximal protection against fires or billowing smoke preceding the fires, it is necessary to install several separate detector units inside and outside the sleeping quarters of a house. Such multiple installations are expensive and difficult to maintain at peak performance.

My invention is then directed towards a self contained smoke/fire detector having two sensor elements, arranged apatially apart but feeding on one power source only, e.g., 9 volt batteries, incorporated therein, for use at separated adjacent locations so as to respond simultaneously to imminent dangers of fire or smoke.

The following U.S. patents were found in a preliminary patentability search directed to devices related to my invention; as described herein:

Nos. 3,778,796; Honda; 1973;
3,908,309; Coulter; 1975;
4,176,346; Johnson; 1979;
4,194,192; Albringer; 1980.

None of the above mentioned patent references discloses a device structurally or otherwise similiar to the present invention.

SUMMARY OF THE INVENTION

In addition to what was stated above, the invented dual detector is primarily intended for traveling purposes, and is foldable to a convenient compact size, so as to snugly fit into even a small suitcase or travel bag.

The detector, according to the invention, is primarily intended for a tourist, businessman, etc., visiting a foreign or strange city or country and staying in a hotel room.

A portable, preferably battery operated, smoke detector is in such cases of particular value, since the traveller is not familiar with fire alarms and escape routes, exits, etc., in the hotel and therefore should more so rely on his own smoke/fire detector.

The present invention is concerned with such a device, which also is installed by merely hanging the detector across the upper edge of the door frame that separates the hotel room from the hallway outside thereof.

The device is then installed in such a manner, that the dual sensor elements of the detector will be located on opposite side of the door and thus respond to hazardous fires or smoke from either side thereof.

The dual sensor system of the detector, as described herein, consists of two separated but interconnected ionization chambers, feeding on the same power source. Obviously, other types or systems of smoke/fire sensing devices could be adapted to the underlying principle of the invention.

The smoke/fire detector, is described and illustrated herein in a basic or schematic manner, as such detectors, per se, are well known in the art and not the gist of the invention.

Thus, it is an object of the invention to provide a portable smoke/fire detector, equipped with dual sensors, for traveling purposes.

It is a further object of the invention to provide such a portable detector for application on doors in hotel rooms, so that its sensors will be located within the room, respectively in the hallway outside.

It is still a further object of the invention to provide a portable fire/smoke detector, which is economical to manufacture, since it basically provides for two sensors, responsive to smoke/fire, but utilizing only one power source, one housing, alarm test button, etc.

Further advantages and objects of my invention will appear from the following description thereof.

BRIEF DESCRIPTION OF THE DRAWINGS

FIG. 1 is an elevational view of the dual smoke/fire detector in a compact state.

FIG. 2 is a top view of the detector, unfolded and straddled across an upper frame portion of a door.

FIG. 3 is a side view of the detector.

FIG. 4 is a top view of another embodiment for the attachment of a second sensor to the detector.

DESCRIPTION OF THE INVENTION

Numeral 10 (FIG. 1) designates the smoke/fire detector, according to the invention.

The conventional components of the detector is numbered as follows in FIGS: 1 through 4.

| | |
|---|---|
| Housing | 12 |
| Grill | 14 |
| Alarm grill | 16 |
| Alarm test button | 18 |
| Ionization chamber | 20 |
| Batteries | 22 |
| Alarm signal box | 24 |

Housing 12 is preferably a rectangular structure, its length being several times the width thereof.

A carrier means, e.g., an inversely directed U-shaped bracket 26, a horizontal portion **26*a* of which is rotably mounted to the upper surface 12*a* of housing 12, by swiveling means, e.g., a pin 12*b*, rotatably connecting bracket 26 and housing 12; one of the vertical downwardly directed arms 26*b* of bracket 26 carries an additional ionization chamber 28 basically identical to conventional ionization chamber 20**.

When bracket 26 is in a compact (inactive) state, its horizontal portion **26*a* is swiveled onto and lies parallely to the top of surface 12*a*; the vertical arms 26*b* of bracket 26 are then disposed vis-a-vis and parallely to the side width surfaces 12*c* of housing 12, with ionization chamber 28 projecting outwardly from the external side of one arm 26*b* (FIG. 1**).

Ionization chamber 28 is connected electrically/electronically in series with the existing ionization chamber 20 by way of wiring 30 (a section of which is seen in FIGS. 1 and 2), both of the ionization chambers (20, 28) are then actuated by a current from the standard batteries and thus activated simultaneously, thereby triggering an alarm.

The detector unit, according to the invention, is as mentioned, self-contained and, by moving horizontal bracket portion **26*a* to a position perpendicular to the longitudinal faces of housing 12, may be hung straddled across the top edge of a door 32 (a section of which is shown in FIG. 2, 3) so that the latter will be accommodated within the space defined by the back of arm 26***b* (carrying ionization chamber 28) and the oppositely lying longitudinal rear surface of housing 12.

Wiring 30, leading from ionization chamber 28 into the interior of housing 12 may be guided by any appropriate means along an edge portion of bracket 26 (not shown).

When the door 32, on which the detector device has been hung is adjacent door jam 34, i.e., closed and separating two spaces, e.g., a hallway into which ionization chamber 28 projects from the outer door surface, and a hotel room which the existing ionization chamber 20 faces (FIG. 3), the detector device, according to the invention, is ready for dual functioning in case of fire, etc.; the alarm test button 18 (part of the conventional smoke detector) may be pushed until alarm sounds, to determine if the detector alarm is at peak performance.

In the event that smoke or fire causes the alarm in the detector to respond, the magnitude of the sound is generally 85 decibel, being sufficient to be heard through closet doors.

Thus, a hotel guest who would apply the detector, according to the invention, will have double protection, that is, he will receive a warning when the alarm goes off, whether smoke or fire originates within the hotel room or outside thereof.

In a second embodiment, bracket 26, has been replaced by a sliding bracket 36, a center section of which is provided with an elongated opening 36*a*, through which two guiding pins 36*b* are integrally mounted to the top surface 12*a* of housing 12 project; the width of the heads of pins 36*b* are greater than the width of channel 36*a* and, therefore hold bracket 36 for sliding motion along top surface 12*a* of housing 12. The purpose of bracket 36 is the same as that of bracket 26, except that ionization chamber 28 must be slit outwardly from a side surface of the housing 12 to be hung on a door, as explained above in detail.

The detector, according to the invention, is primarily intended for being mounted across the top of a door, but could conceivably be applied to any surface separating two enclosed spaces.

The vertical arm 26*b* of bracket 26 (which does not carry ionization chamber 28) may have a hook 26*c*, and also, accommodate a red ribbon 40, to remind the hotel guest to remove the detector prior to departing.

One could also use a bright colored sack or bag (in which the detector may be wrapped) to be hung on hook 26*b*, when the detector is mounted on the door frame.

While the foregoing has illustrated and described what is now contemplated to be the best mode of carrying out the invention, the above embodiments of my invention are, of course, subject to modifications without departing from the spirit and scope of the invention. Therefore, it is not desire to restrict the invention to the particular constructions illustrated and described but to cover all modifications, that may fall within the scope of the appended claims.

I claim:

1. In a smoke and fire detector device, including a housing, incorporating a sensor, an electric power source and an alarm signaling box, connected electrically to each other for smoke and fire induced activation of the device, comprising:

(a) carrier means mounted to an exterior portion of the housing.

(b) a second sensor electrically interconnected with the power source, sensor and alarm signaling box, mounted to the carrier means in a spaced relationship to the sensor in the housing, so that, when the carrier means is placed across the top of a door, the two sensors may activate the device in adjacent rooms separated by the door.

2. A device, according to claim 1, wherein the sensors are ionization chambers.

3. A device, according to claim 1, wherein the length of the housing is several times greater than the width thereof.

4. A device, according to claim 3, wherein the carrier means is a U-shaped bracket, having a horizontal base from which two arms extend downwardly, when mounted to the housing.

5. A device, according to claim 4, wherein the second sensor is mounted to and projects outwardly from one of the arms of the bracket, the horizontal part thereof being mounted rotatably on top of the housing, with the arms of the bracket lying adjacent the width surface of the housing, for swiveling into a position of parallel spaced relationship to the length sides thereof.

6. A device, according to claim 4, wherein the second sensor is mounted to and projects outwardly from one of the arms of the bracket, the horizontal base of which has an elongated opening along a center section thereof and is mounted slidably along the upper surface of the housing by means of headed pins extending integrally therefrom and through the elongated opening of the bracket, so that the sensor carrying bracket arm is outwardly slidable into a position for straddling across the edge of a door.

7. A device, according to claim 5, wherein the free arm of the bracket carries a hook for accommodation of a key and/or a colored ribbon.

* * * * *